United States Patent [19]

Damsgaard

[11] Patent Number: 4,538,785

[45] Date of Patent: Sep. 3, 1985

[54] MOUNTING FOR THE SETTING UP OF BLINDS

[75] Inventor: Raymond Damsgaard, Ryslinge, Denmark

[73] Assignee: A/S Chr. Fabers Fabriker, Ryslinge, Denmark

[21] Appl. No.: 548,010

[22] Filed: Nov. 2, 1983

[30] Foreign Application Priority Data

Nov. 22, 1982 [DK] Denmark ..... 5186/82

[51] Int. Cl.[3] ..... A47H 1/10

[52] U.S. Cl. ..... 248/268

[58] Field of Search ..... 248/248, 254, 264, 266–272, 248/245, 252

[56] References Cited

U.S. PATENT DOCUMENTS

| | | | |
|---|---|---|---|
| 1,253,699 | 1/1918 | McCord | 248/254 |
| 1,388,346 | 8/1921 | Kirsch | 248/267 |
| 3,595,511 | 7/1971 | Summerville | 248/264 |
| 4,270,720 | 6/1981 | Fulcuchi | 248/269 |

FOREIGN PATENT DOCUMENTS

| | | | |
|---|---|---|---|
| 176522 | 10/1906 | Fed. Rep. of Germany | 248/264 |

*Primary Examiner*—Reinaldo P. Machado
*Assistant Examiner*—Alvin Chin-Shue
*Attorney, Agent, or Firm*—Holman & Stern

[57] ABSTRACT

For the setting up of blinds with a blind roller which has at one end a round-end-view cylindrical ("round") axle journal and at the other end an angular axle journal which is in connection with a spring mechanism in the interior of the blind roller, wherein are used two mountings which are intended to be fixed at the ends of the blind roller and at one end is an angular bearing for the taking up and securing against rotation of an axle journal with angular cross-section and at the other end a round bearing for the taking up of a round axle journal. The mounting comprises a plate angle, which has in both sides holes for fixed screws, and one side of which has on its internal surface four punched and bent pockets, which have been shaped and placed in the corners of a square in such a way that each pocket is open towards the two neighboring pockets, and an inlay with two carrying surfaces, which are shaped in such a way that they can be pushed and secured and carried by two neighboring pockets on the plate angle, and with two legs which delimit between them an essentially U-shaped bearing for an axle journal. From identical plate angles and a set of inlays it is possible to compose, at the place of mounting, a mounting which satisfies many different usages.

3 Claims, 7 Drawing Figures

MOUNTING FOR THE SETTING UP OF BLINDS

The present invention concerns a mounting for the setting up of blinds and of the kind described in the first part of claim 1.

Mountings for blinds are usually made in pairs, namely a mounting with an angular bearing for the fixation against rotation of the angular axle journal, so that the spring mechanism in the blind roller is secured when the roller is rotated on its longitudinal axis, and a mounting with a round end-view cylindrical bearing which permits the blind roller to rotate. Such mountings must be available for setting up on walls, on ceilings, on side rabbets, and on floors. In all cases the angular bearing must be shaped in the mounting in such a way that the opening through which the axle journal is introduced is oriented in such a way after the mounting has been set up that the blind cannot fall out of the mounting. Besides, in all the cases mentioned the mountings must be available in laterally reversed form.

This implies that the mountings must be produced and stocked in a very large number of variants. Besides, there is a considerable risk of faulty orders from users, and in many cases this is not noticed until the moment when the blind is to be set up.

The purpose of the invention is to provide a mounting of the mentioned kind, but without the disadvantages mentioned.

This is obtained according to the invention by means of the design described in claim 1.

By means of this design it is possible to compose of identical plate angles and set of inlays—by inserting an inlay into the plate angle—mountings which satisfy the applications mentioned in the introduction, and this can be done in the place where the mounting is to be used. Thereby rational production is obtained, it is not necessary to carry large stocks, and—last but not least—the user never gets the wrong mountings.

In cases where at any rate the inlay is made of plastic it is appropriate according to the invention that the mounting is shaped as indicated in claim 2. Hereby a further retention of the inlay in the plate angle is obtained.

If the mounting is shaped as indicated in claim 3, the blind roller is prevented with certainty from falling out of the mounting, e.g. if the blind is pulled obliquely or in the case of impacts on the blind roller.

Figure 1:
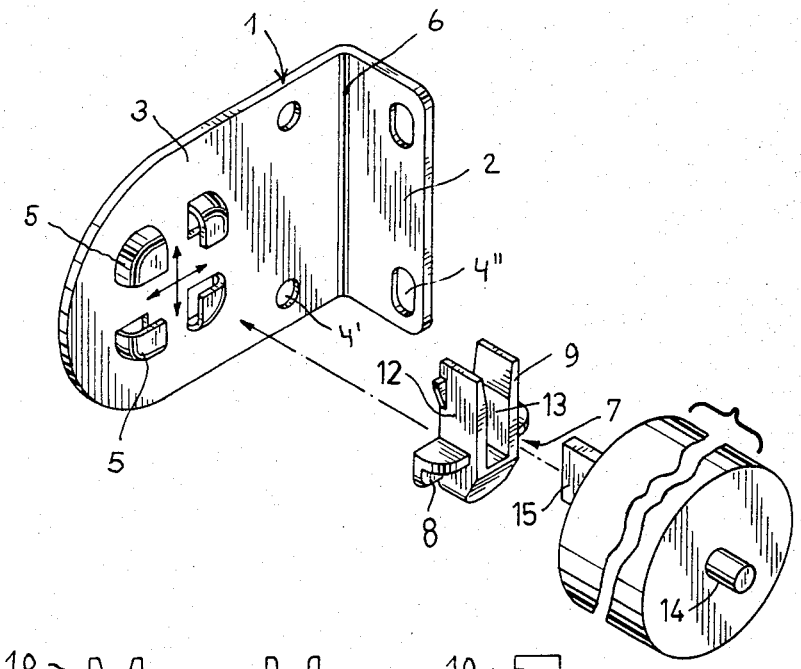
Figure 2A:
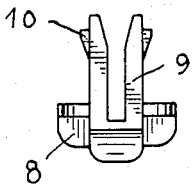
Figure 2B:
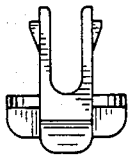
Figure 2C:
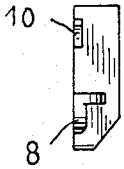
Figure 3A:
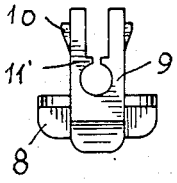
Figure 3B:
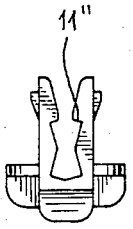
Figure 3C:
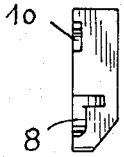

In the following the invention will be explained in more detail in connection with the drawing, where FIG. 1 shows a mounting according to the invention in perspective, FIG. 2 shows one design for a set of inlays to be used together with the plate angle shown in FIG. 1, and FIG. 3 shows another design for a set of inlays.

The mounting for the setting up of blinds shown in FIG. 1 comprises a plate angle (1), which has in both sides (2) and (3) holes (4',4'') for fixed screws, by which the plate angle (1) can be secured to e.g. a wall or a ceiling. One angle side (3) has on its internal surface four pockets (5), which have been punched out and bent of the plate material. The pockets (5) are shaped and placed in the corners of a square in such a way that each pocket is open towards the two neighbouring pockets.

Each and every set of two adjacent pockets make up a carrier organ in which an inlay (7) can be placed. Therefore the inlay (7) has two carrying surfaces (8), shaped in such a way that they can be inserted into two neighbouring pockets and secured in them. Further, the inlay (7) has two legs (9), which delimit between them an essentially U-shaped bearing for an axle journal on a blind roller.

A blind roller has at one end a round-end-view cylindrical axle journal (hereinafter referred to as "round axle journal") (14) and at the other end an angular axle journal (15), which is in connection with a spring mechanism in the interior of the roller. While the round axle journal can rotate in the mounting, the angular axle journal must be secured against rotation in the mounting, so that the spring mechanism collaborating with the axle journal can work when the blind is rolled up, either by provoking or braking the rolling-up. Accordingly the inlays (7) for the two axle journals can be shaped as shown in FIGS. 2 and 3.

In all the designs shown the two legs (9) of the inlay (7) have on their outer surfaces (12) wedge-shaped flaps (10), which can be snapped into the two pockets (5) opposite to the pockets that accommodate the carrying surfaces (8).

In the design shown in FIG. 3 the two legs (9) of the inlay (7) have on their inner surfaces (13) projections (11',11''). These projections are placed in such a way that an axle journal that is placed in the bearing cannot pass the projections as a matter of course. If the inlay (7) is made of an elastic material, e.g. plastic, the legs (9) can be forced apart, so that the axle journal can pass the projections (11',11''), although the distance between these free ends facing each other is smaller than the diameter of the axle journal. In connection with the round axle journal, which can be inserted axially into the bearing, it is not necessary for the legs (9) of the inlay to be separated elastically. In the case of the angular axle journal the free distance between the projections (11'') can always be larger than the transverse measurement of the axle journal. The angular axle journal will be placed by the operation of the blind and its spring mechanism in such an oblique position that it is normally fixed under one of the two projections (11'') (FIG. 3*b*).

I claim:

1. Mountings for the setting up of blinds with a blind roller which has at one end a round-end-view cylindrical axle journal and at the other end an angular axle journal, and where two such mountings are intended to be mated to the ends of the blind roller and to form at one end an angular bearing for the taking up and securing against rotation of an axle journal with angular cross-section, and at the other end a round bearing for the taking up of a round axle journal, said mountings each comprising a plate angle, and suitably mated inlay, said plate angle which itself comprises two sides having holes for use by fixed screws, and one side of said plate angle comprises an internal surface having four punched-and-bent pockets, which have been shaped from and placed in the corners of a square of said surface in such a way that each said pocket is open towards the two neighbouring pockets, said inlay comprising two carrying-surfaces, and two legs, said carrying surfaces suitably shaped such that they can be pushed into and carried by two neighbouring pockets on said plate angle, said two legs each having inner surfaces and outer surfaces, delimiting between said legs an essentially U-shaped bearing for an axle journal, one inlay for said axle journal of angular cross-section and the other inlay for said round-end-view cylindrical axle journal.

2. Mountings according to claim 1 and where at least the inlay is made of plastic or a similar somewhat elastic material, whereby said outer surfaces of said two legs of said inlay comprises wedge-shaped flaps, suitably shaped and placed in such a way that when said carrying-surfaces of said inlay have been suitably inserted into two neighbouring pockets, said wedge-shaped flaps can be suitably secured to said plate angle by the two other pockets.

3. Mountings according to claim 1, wherein said inner surfaces of said two legs further comprise projections, suitably placed such that an axle journal placed in the bearing formed by said legs cannot pass through said projections as a matter of course.

* * * * *